US012035807B2

(12) United States Patent
Arias et al.

(10) Patent No.: US 12,035,807 B2
(45) Date of Patent: Jul. 16, 2024

(54) INFANT FLOAT

(71) Applicant: SPIN MASTER, INC., Williamsville, NY (US)

(72) Inventors: David A. Arias, Virginia Beach, VA (US); Timothy James Clemens, Virginia Beach, VA (US); Theresa M. Bannon, Virginia Beach, VA (US); Laurel A. Roney, Virginia Beach, VA (US); David J. Crowe, Virginia Beach, VA (US)

(73) Assignee: SPIN MASTER, INC., Williamsville, NY (US)

( * ) Notice: Subject to any disclaimer, the term of this patent is extended or adjusted under 35 U.S.C. 154(b) by 0 days.

(21) Appl. No.: 18/313,059

(22) Filed: May 5, 2023

(65) Prior Publication Data

US 2023/0270257 A1 Aug. 31, 2023

Related U.S. Application Data

(60) Continuation of application No. 17/446,560, filed on Aug. 31, 2021, now Pat. No. 11,666,153, which is a (Continued)

(51) Int. Cl.
*A47C 15/00* (2006.01)
*A47C 7/66* (2006.01)
(Continued)

(52) U.S. Cl.
CPC ..... *A47C 15/006* (2013.01); *A47C 7/666* (2018.08); *A47D 1/00* (2013.01); *A47L 1/00* (2013.01); *B63C 9/08* (2013.01); *B63C 2009/042* (2013.01)

(58) Field of Classification Search
CPC .. B63C 9/081; B63C 9/04; B63C 9/08; B63C 9/082; B63C 9/1055; B63C 2009/042;
(Continued)

(56) References Cited

U.S. PATENT DOCUMENTS 3,740,095 A * 6/1973 Nail ..... B63B 34/52 441/130
5,409,411 A * 4/1995 Schrieber ..... B63C 9/08 5/655

(Continued)

*Primary Examiner* — Daniel V Venne
(74) *Attorney, Agent, or Firm* — Aird & McBurney LP

(57) ABSTRACT

This application relates to inflatable flotation devices that support an infant, and having first, second and third inflatable members. The first member has an outer and an inner perimeter and a first and second diameters at first and second end portions. The second member is at least partially within the inner perimeter of the first member. At least a portion of the upper surface of the second member is recessed with respect to an upper surface of the first member. The third member has an inner perimeter disposed about at least a portion of the outer perimeter of the first member. The third member has a maximum height, when inflated, that is less than the maximum height of the first member, at least a portion of the inner perimeter of the third member being spaced apart from the outer perimeter of the first member.

6 Claims, 8 Drawing Sheets

Related U.S. Application Data division of application No. 16/551,096, filed on Aug. 26, 2019, now Pat. No. 11,103,075, which is a division of application No. 15/914,685, filed on Mar. 7, 2018, now Pat. No. 10,433,649.

(60) Provisional application No. 62/473,094, filed on Mar. 17, 2017.

(51) Int. Cl.

| | |
|---|---|
| ***A47D 1/00*** | (2006.01) |
| ***A47L 1/00*** | (2006.01) |
| ***B63C 9/04*** | (2006.01) |
| ***B63C 9/08*** | (2006.01) |

(58) Field of Classification Search

CPC ..... B63B 7/08; B63B 35/607; B63B 35/73; B63B 35/76; A47C 15/006; A47C 15/666; A47D 1/00

USPC .. 441/35, 40, 65, 66, 72, 73, 125, 126, 129, 441/130, 131, 132

See application file for complete search history.

(56) References Cited

U.S. PATENT DOCUMENTS

| | | | | |
|---|---|---|---|---|
| 6,589,089 | B1 * | 7/2003 | Glass | B63C 9/30 441/130 |
| 7,008,281 | B2 * | 3/2006 | Ketko | B63C 9/02 441/130 |
| 7,210,976 | B2 * | 5/2007 | Gordon | B63B 34/52 472/117 |
| 8,057,272 | B1 * | 11/2011 | Wray | A47D 1/00 441/80 |

* cited by examiner

INFANT FLOAT

CROSS-REFERENCE TO RELATED APPLICATIONS

This application is a continuation of U.S. patent application Ser. No. 17/446,560 filed Aug. 31, 2021, now granted as U.S. patent Ser. No. 11/666,153, which is a divisional of U.S. patent application Ser. No. 16/551,096, filed on Aug. 26, 2019, now granted as U.S. Pat. No. 11,103,075; which is a divisional of U.S. patent application Ser. No. 15/914,685, filed on Mar. 7, 2018, which is now granted as U.S. Pat. No. 10,433,649 and which claims priority to and the benefit of U.S. provisional patent application No. 62/473,094, filed on Mar. 17, 2017, the entirety of each of which is incorporated by reference herein.

BACKGROUND

This application relates to flotation devices generally, and particularly to inflatable flotation devices configured for use by an infant to support the infant at least partially above the water and to at least partially retain the infant therein.

Known recreational flotation devices on which a user can lay, sit and/or recline while floating on water are often designed for use by young adult and/or adult users. Some known recreational flotation devices geared towards children, or even infants, are designed such that the user sits substantially upright with a portion of the lower body submerged when the flotation device is on water and the user is disposed on the apparatus. Such known devices are not appropriate for younger infants that have not yet developed sufficient muscular control to retain themselves in an upright position. Such known devices also submerge more of the user's body—and particularly the user's lower body—into the water during use than what may be desirable for a younger infant.

Thus, a need exists for a flotation device for use by a child or infant that permits the infant to rest thereon with one or more portions of the lower body optionally supported above the water. A need also exists for a flotation device for use by an infant or other user that is unable to (or has limited ability to) sit upright on his or her own.

SUMMARY

This application relates to flotation devices generally, and particularly to inflatable flotation devices configured for use by an infant to support the infant at least partially above the water and to at least partially retain the infant therein. In some embodiments, an apparatus is a flotation member having an inner perimeter, a top portion and a bottom portion. The flotation member has a first height between its bottom portion and its top portion at a first location of the flotation member. The flotation member has a second height between the top portion and the bottom portion at a second location of the flotation member, the second height different from the first height. The flotation member includes a support member at least partially disposed within the inner perimeter of the flotation member. The support member has a first portion coupled to the top portion of the flotation member at the first location. The support member has a second portion coupled to the top portion of the flotation member at the second location. The support member has a third portion between the first portion and the second portion. The third portion is coupled to the bottom portion of the flotation member at a third location different from the first location of the flotation member and the second location of the flotation member.

DETAILED DESCRIPTION

Figure 1:
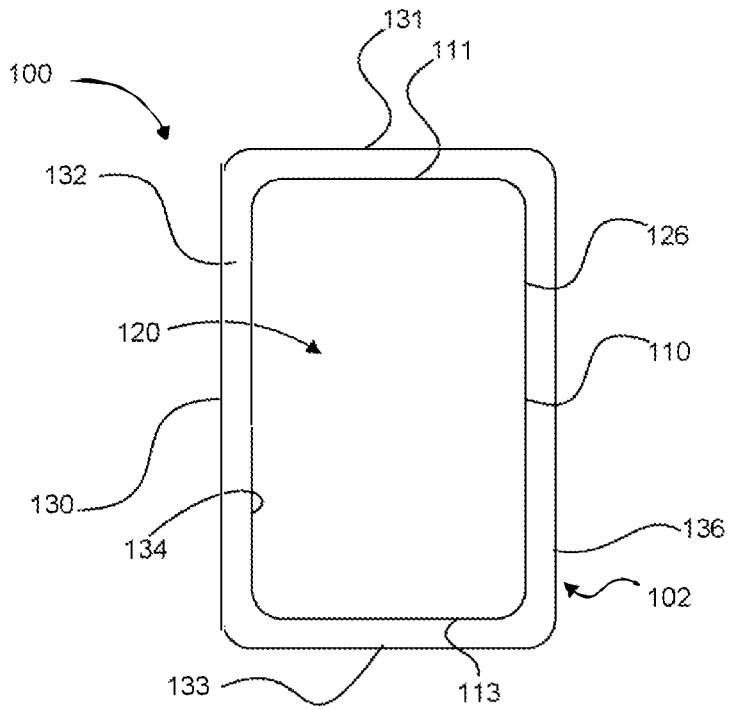
FIG. 1 is a top schematic view of a flotation apparatus according to an embodiment.

Apparatus for flotation and recreational use on the water are generally disclosed herein, and more particularly a flotation device for infants is disclosed herein.

As used in this specification and the appended claims, the singular forms "a," "an" and "the" include plural referents unless the context clearly dictates otherwise. Thus, for example, the term "a member" is intended to mean a single member or a combination of members, "a material" is intended to mean one or more materials, or a combination thereof.

As used herein, the terms "reversible," "reversibly," and/or the like when used to describe a process and/or procedure generally refer to a non-destructive process or procedure that can be subsequently undone by a similar yet substantially opposed, inverse, and/or opposite non-destructive process or procedure. When used herein with respect to attachment and/or detachment of an element or assembly, a reversible attachment refers to a non-destructive, repeatable attachment and/or detachment of the element or assembly.

As used herein, the terms "about" and/or "approximately" when used in conjunction with numerical values and/or ranges generally refer to those numerical values and/or ranges near to a recited numerical value and/or range. For example, in some instances, "about 40 [units]" can mean within ±25% of 40 (e.g., from 30 to 50). In some instances, the terms "about" and "approximately" can mean within ±10% of the recited value. For example, the term "approximately an entirety" can mean within ±10% of 100%. In other instances, the terms "about" and "approximately" can mean within ±9%, ±8%, ±7%, ±6%, ±5%, ±4%, ±3%, ±2%, ±1%, less than ±1%, or any other value or range of values therein or therebelow. The terms "about" and "approximately" may be used interchangeably. Furthermore, although a numerical value modified by the term "about" or "approximately" can allow for and/or otherwise encompass a tolerance of the stated numerical value, it is not intended to exclude (and more specifically can include) the exact numerical value stated.

In a similar manner, term "substantially" when used in connection with, for example, a geometric relationship, a numerical value, and/or a range is intended to convey that the geometric relationship (or the structures described thereby), the number, and/or the range so defined is nominally the recited geometric relationship, number, and/or range. For example, two structures described herein as being "substantially parallel" is intended to convey that, although a parallel geometric relationship is desirable, some non-parallelism can occur in a "substantially parallel" arrangement. By way of another example, a structure defining a diameter that is "substantially 100 millimeters (mm)" is intended to convey that, while the recited diameter is desirable, some tolerances can occur when the volume is "substantially" the recited volume (e.g., 100 mm). Such tolerances can result from manufacturing tolerances, measurement tolerances, and/or other practical considerations (such as, for example, minute imperfections, age of a structure so defined, a pressure or a force exerted within a system, and/or the like). As described above, a suitable tolerance can be, for example, of ±1%, ±2%, ±3%, ±4%, ±5%, ±6%, ±7%, ±8%, ±9%, ±10%, or more of the stated geometric construction, numerical value, and/or range. Furthermore, although a numerical value modified by the term "substantially" can allow for and/or otherwise encompass a tolerance of the stated numerical value, it is not intended to exclude (and more specifically can include) the exact numerical value stated.

While numerical ranges may be provided for certain quantities, it is to be understood that these ranges can include all subranges therein. Thus, the range "from 5 to 10" includes all possible ranges therein and all values within a given range may be an endpoint for the range encompassed thereby (e.g., 6-10, 7-10, 8-10, 9-10, 5-9, 6-9, 7-9, 8-9, 5-8, 6-8, 7-8, 6-8, 7-8, 8-9, or fractions thereof).

As used herein, and unless the context clearly indicates otherwise, the words "proximal" and "distal" refer to the direction closer to and away from, respectively, a user (e.g., a user disposed on the apparatus).

Figure 2:
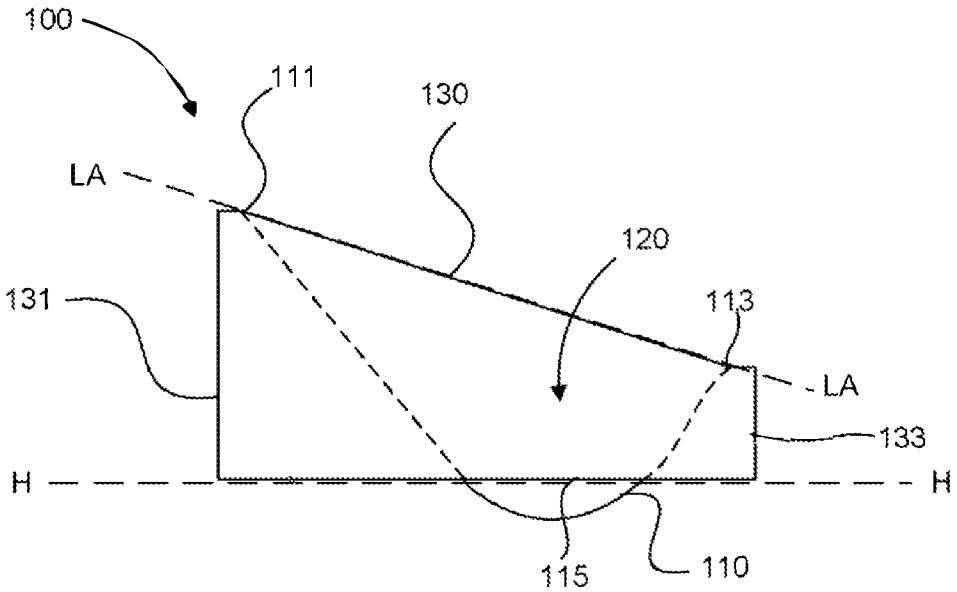
FIG. 2 is a side schematic view of the apparatus of FIG. 1, with portions shown in broken lines for illustration purposes only.

An apparatus 100 according to an embodiment is schematically illustrated in FIGS. 1-2. The apparatus 100 can be, for example, a flotation device for supporting a user and particularly an infant, on and at least partially above a surface of water or other suitable liquid. The apparatus 100 has a cradle 102 that includes a support member 110 and a wall portion 130 (or bulkhead portion) disposed about at least a portion of a perimeter (e.g., an outer perimeter 126) of the support member 110. In some embodiments, the wall portion 130 is disposed about substantially the entirety of the outer perimeter 126 of the support member 110.

The support member 110 is configured for a user (e.g., an infant) to be disposed thereon. The support member 110 and the wall portion 130 collectively define a seat portion 120 that is recessed with respect to an upper surface of the wall portion 130 and within which at least a portion of the user can be disposed for using the flotation device 100. In use, the infant or other user can be disposed on the support member 110 in a seat portion 120 in a position between an upright seated position and a supine position such that the user is at least partially within the volume defined by the wall portion 130 and the support member 110. The foregoing position between the upright seated position and the supine position is referred to herein as a "reclined position," solely for the sake of simplicity and without limiting the term "reclined position" to include only a position between the upright seated position and the supine position in other contexts.

The wall portion 130 is configured to help retain at least a portion of the user within the seat portion 120. For example, the seat portion 120 can be configured to receive at least a portion of an infant's head, torso, and upper legs, with the user's knee(s) optionally disposed on and/or over a portion of the wall portion 130 and with the lower leg(s) and foot (feet) optionally disposed exterior to an outer perimeter 136 of the wall portion 130. Because the wall portion 130 extends upwardly (or transversely) to at least a portion of the upper surface of the support member 110, in use, the wall portion 130 helps to prevent the infant from rolling over and/or off of the support member 110. The wall portion 130 is also configured to help prevent, or reduce the amount of, water entering the volume of seat portion 120 (e.g., from over top of the wall portion 130) when the apparatus 100 is in use on water.

A first portion 131 of the wall portion 130 can have a first height and a second portion 133 of the wall portion 130 can have a second height different than the first height. For example, in some embodiments, the first portion 131 of the wall portion 130 is adjacent the user's head when the device is in use and has the first height that is greater than the second portion 133 of the wall portion 130 adjacent the user's legs and/or beneath the user's legs when the device is in use. In some embodiments, the first height of the first portion 131 of the wall portion 130 is within the range of about 5 inches to about 10 inches, about 6 inches to about 9 inches, or about 7 inches to about 8 inches. In some embodiments, the second height of the second portion 133 of the wall portion 130 is within the range of about 1 inch to about 5 inches, about 2 inches to about 4 inches or about 3 inches to about 4 inches. For example, in some embodiments, the first height is about 7.5 inches and the second height is about 3.4 inches. In some embodiments, the first portion 131 and the second portion 133 of the wall portion 130 have the first and second heights, respectively, when the wall portion 130 is inflated, e.g., to one of a maximum or threshold volume.

In some embodiments, the wall portion 130 decreases in height from the first portion 131 of the wall portion 130 to the second portion 133 of the wall portion 130. For example, an upper surface 132 of the wall portion 130 can be sloped or otherwise inclined from the first portion 131 of the wall portion 130 to the second portion 133 of the wall portion 130. In this manner, for example, the upper surface 132 of the wall portion 130 can have (or be substantially coincident with) a longitudinal axis LA that forms an angle with respect to a horizontal plane H (see, e.g., FIG. 2). A lower surface of the wall portion 130, opposite the upper surface 132, can be substantially horizontal.

The wall portion 130 is buoyant (e.g., on water or other suitable liquid). In this manner, the wall portion 130 is a flotation member. In some embodiments, the wall portion 130 includes a membrane and an inflatable bladder (not shown in FIGS. 1-2). In some embodiments, the membrane of the wall portion 130 defines at least a portion of a sleeve within which the inflatable bladder is disposed. The membrane can be constructed of a flexible material. In some embodiments, the membrane is impermeable to liquid. In other embodiments, the membrane is liquid (e.g., water) permeable. In some embodiments, the membrane of the wall portion 130 is optional. For example, the wall portion 130 can include the inflatable bladder without a membrane.

In some embodiments, the inflatable bladder includes multiple inflatable chamber portions. Two or more of the inflatable chamber portions can be vertically stacked within the wall portion 130. One or more inflatable chamber portions of the inflatable bladder can be formed, for example, by one or more welded portions of the inflatable bladder. In some embodiments, the inflatable bladder forms at least one loop within the sleeve of the membrane of the wall portion 130. In some embodiments, the inflatable bladder is (or the inflatable chamber portions collectively) are looped within the sleeve one time, one and a half times, two times, two and a half times, or more. Said another way, for example, the inflatable bladder (or the inflatable chamber portions collectively) can be looped about the inner perimeter of the flotation member at least 1.0 times. In some embodiments, an inflatable chamber segment can be stacked or otherwise positioned above another inflatable chamber segment for each loop, or portion thereof, above the first loop. In some embodiments, a first portion of the inflatable bladder of the wall portion 130 has a greater cross-sectional surface area than a cross-sectional surface area of a second portion of the inflatable bladder of the wall portion 130.

The support member 110 of the cradle 102 can be flexible. The support member 110 can be buoyant. In some embodiments, the support member 110 includes a membrane (not shown in FIGS. 1-2) and an inflatable bladder (not shown in FIGS. 1-2). In other embodiments, the support member 110 is constructed of a floatable or buoyant (e.g., non-inflatable) material. The membrane, the inflatable bladder, or both can be flexible. The membrane of the support member 110 can include a first layer and a second layer and define a pocket therebetween. The inflatable bladder can be disposed in the pocket of the membrane of the support member 110.

The support member 110 is coupled to the wall portion 130. In some embodiments, at least a portion of an outer perimeter portion (e.g., from a top view) of the support member 110 (e.g., the support member membrane's first and/or second layer) is coupled to the wall portion 130 of the apparatus 100. In some embodiments, substantially an entirety of the outer perimeter 126 of the support member 110 is coupled to the wall portion 130. The outer perimeter 126 of the support member 110 is coupled to the wall portion 130, e.g., an inner perimeter 134 of the wall portion, such that opposing first and second end portions of the support member 110 are coupled to the wall portion 130 at first and second locations, respectively, that are substantially at the first height of the wall portion 130 and the second height of the wall portion 130, respectively, and such that opposing side portions of the support member 110 disposed between the support member's 110 opposing first and second end portions are coupled to the wall portion 130 at a third location that is lower than the first height and less than the second height. The third height of the wall portion 130 can be, for example, a height that is substantially zero inches (e.g., a bottom of the wall portion 130).

Ends of the inflatable bladder can be coupled to opposing end portions of the wall portion 130 at approximately the first height and second height, respectively. In this manner, a first end of the inflatable bladder of the support member 110 is separated by a first distance (e.g., the first height of the wall portion 130) from a support surface (e.g., a surface of the water, or from the second, or lower, surface of the wall portion) that is greater than a second distance by which a second end of the inflatable bladder of the support member 110 is separated from the support surface (or second surface of the wall portion). In some embodiments, the support member 110 has a longitudinal cross-sectional profile (e.g., taken along a longitudinal axis that extends at least between the first end portion of the inflatable bladder and the second end portion of the inflatable bladder, along the longer dimension of support member 110) that includes a concave portion. In some embodiments, the support member 110 has a longitudinal cross-sectional profile that includes a convex portion and a concave portion. In some embodiments, the support member 110 has a latitudinal cross-sectional profile (e.g., taken along a latitudinal axis that extends from a first side of the support member to a second, opposing side of the support member, along the shorter dimension of the support member 110) that includes a concave portion.

In some embodiments, the support member 110 is configured to receive and/or conform to different sized and/or shaped users (e.g., infants). In some embodiments, for example, the inflatable bladder of the support member 110 is configured to produce a pillow effect such that air within the inflatable bladder is displaced therein in response to varying weight or pressure applied by various portions of the user's body disposed thereon. In this manner, the support member 110 is configured to conform, at least in part, to the body of the user.

In some embodiments, when air (or other gas) within the inflatable bladder is displaced therein in response to the user's body being disposed thereon, a first portion 111 of the support member 110 can have a first thickness (e.g., measured in a direction taken between an upper surface of the support member 110 and the lower surface of the support member 110) and a second portion 115 of the support member 110 can have a second thickness less than the first thickness. In some such embodiments, a third portion 113 of the support member 110 can have a third thickness greater than the second thickness. For example, the first portion 111 of the support member 110 can be proximate the user's head, the second portion 115 of the support member 110 can be proximate the user's buttocks and the third portion 113 of the support member 110 can be proximate the user's upper leg. The second portion 115 of the support member 110, being thinner than the first and third portions 111, 113 of the support member 110 when the user is disposed thereon, helps to more easily retain or wedge in the user (e.g., an infant). Said another way, in some embodiments, the support member 110 can have a thinner or flatter portion (e.g., due to air being dispersed therein or due to construction of the support.

In some embodiments, the inflatable bladder of the support member 110 includes one, two, three, four, five, six, seven, eight, nine, ten, eleven, twelve, or more inflatable segments, two or more of which can be fluidically coupled. In this manner, the two or more inflatable segments can be inflated via a single valve. In some embodiments, the inflatable bladder is welded in a manner to produce two or more inflatable segments that are fluidically coupled. The inflatable segments of the support member 110 can be arranged in substantially stacked or parallel rows. Such a segmented inflatable bladder allows the support member 110 to better conform to the user's shape (e.g., compared to an unsegmented inflatable bladder) and also helps to keep the center of gravity low for the user rested thereon. The segmented inflatable bladder also provides a pillow-like portion adjacent the first end portion 131 of the wall portion 130, and on which the user's head can be disposed during use. In some embodiments, one or more of the inflatable segments of the inflatable bladder is configured to be compressed when the user is rested thereon. In other embodiments, the support member 110 can include two or more inflatable bladders in lieu of any one or more or all of the inflatable segments.

In some embodiments, the flotation device 100 includes a stabilizing member (not shown in FIGS. 1-2) disposed about at least a portion of an outer perimeter 136 of the wall portion 130 of the flotation device. The stabilizing member is configured to lower the center of gravity of the flotation device 100, thereby helping to prevent the flotation device from tipping over during use, for example, if the user (e.g., an infant) reaches over the wall portion 130 of the flotation device towards the water. The stabilizing member can be coupled (indirectly or directly) to the wall portion 130 of the flotation device. The stabilizing member can be buoyant, and optionally can be inflatable. The stabilizing member can form a closed loop around the cradle 102. The stabilizing member 150 have any suitable shape, including, but not limited to a substantially toroidal or oval shape.

In some embodiments, the flotation device 100 includes a safety harness (not shown in FIGS. 1-2) configured to retain the user to the flotation device 100, to help prevent an infant from crawling or otherwise pulling himself or herself out of the seat portion 120. In some embodiments, the flotation device includes a coilable spring that is configured to fold upon itself to become more compact. The coilable spring can be coupled to a perimeter of the flotation device, for example to the stabilizing member or to the cradle 102. The coilable spring can move the flotation device between a first configuration in which the coilable spring is collapsed and the flotation device is folded in upon itself and a second configuration in which the coilable spring is extended and the flotation device is unfolded (and inflated or ready for inflation). In some embodiments, one or more inflatable members of the flotation device are inflated to maintain the coilable spring in the extended configuration, thus retaining the flotation device in the second configuration.

The coilable spring can be manufactured from a waterproof material or coated with a waterproof material. The coilable spring can be constructed of any suitable material, including but not limited to, metal (e.g., steel), plastic or other material. The coilable spring can be a single continuous element or can include multiple spring elements, which can optionally be coupled together by a joint, such as a sleeve joint, that joins the ends of one or more spring elements. The coilable spring can be of any appropriate shape and dimension. The coilable spring, in some embodiments, has shape memory such that is biased to return to its uncoiled configuration when not held in the coiled configuration (e.g., by inflation of one or more inflatable bladders of the flotation device, such as the inflatable bladder of the stability member). The coilable spring can be similar in many respects or identical to the coilable spring disclosed in U.S. Pat. No. 9,849,949, entitled "Collapsible Flotation Device, issued Dec. 26, 2017, which is incorporated herein by reference.

In some embodiments, the flotation device includes a canopy (not shown in FIGS. 1-2). The canopy can be reversibly couplable to the flotation device, for example, via one, two, three, four or more of at least one of snaps, straps, buttons, buckles, ties, hook-and-loop fasteners (e.g., Velcro®), or the like, or a combination of the foregoing. The canopy can be configured to shield at least a portion of the user's body, when seated within the seating portion 120 of the flotation device, from ultraviolet rays of the sun. At least a portion of the canopy can include a sun protective Ultraviolet Protection Factor ("UPF") rated fabric or coating (e.g., with a UPF rating of UPF 50, UPF 40, or the like). In some embodiments, at least a portion of the canopy is constructed of a flexible material similar to that used for one or more membranes of the flotation device, such a flexible material, a permeable material, a mesh material, or any other suitable material described herein. The canopy can be movable with respect to the flotation device. For example, the canopy can have a first position in which a first (or rear) edge of the canopy is in contact with or spaced less than 5 inches apart from an upper surface of a first portion of the flotation device or a second position in which the first edge of the canopy is spaced 5 inches or more apart from the upper surface of the first portion of the flotation device.

An apparatus 200 according to an embodiment is illustrated in FIGS. 3-13. The apparatus 200 can be, for example, a flotation device similar in many respects, or identical, to the apparatus 100 described herein. The flotation device 200 is configured to support a user, and particularly an infant, on and at least partially above a surface of water or other suitable liquid. More particularly, the flotation device 200 is configured to support the user in a reclined position thereon such that at least a portion of the infant's head and torso is above the water and such that at least a portion of the infant's buttocks are disposed at or below a surface of the water, as described herein.

The flotation device 200 has a cradle 202 that includes a support member 210 and a wall portion (or flotation member, e.g., a first flotation member) 230 disposed about at least a portion of a perimeter (e.g., an outer perimeter 226, from a top view) of the support member 210. The support member 210 is configured for the user (e.g., the infant) to be disposed thereon. The support member 210 and the wall portion 230 collectively define a volume 220 within which at least a portion of the user's body can be disposed for using the flotation device 200, e.g., to float on water, and therefore may be said to be collectively configured to support a user in a reclined position on a fluid surface of a fluid. The support member 210, wall portion 230 and volume 220 can collectively form a seating portion of the flotation device 200, as described herein.

The wall portion 230 includes a first (or upper) surface 232, a second (or lower surface) 234, a third (or inward-facing) surface 236, and a fourth (or outward-facing) surface 238. The wall portion 230 can have any suitable thickness between the third surface 236 and the fourth surface 238 including, for example, a thickness of about one inch to five inches, about one inch to about three inches, or about two inches to about three inches. At least a portion of the wall portion 230 can be raised with respect to (e.g., extend transversely or substantially perpendicularly to) at least a portion of the first surface 212 of the support member 210. In use, the infant (or other user) can be reclined on the support member 210 of the flotation device 200 such that the infant is at least partially within the volume 220 defined by the wall portion 230 and the support member 210. For example, the volume 220 can be configured to receive at least a portion of an infant's head, torso, and upper legs, with the user's knee(s) optionally disposed on and/or over a portion of the wall portion 230 and with the lower leg(s) and foot (feet) optionally disposed exterior to an outer perimeter of the wall portion 230. As such, the wall portion 230 is configured to help retain at least a portion of the user within the volume 220. Said another way, because the wall portion 230 extends transversely to the first surface 212 of the support member 210, in use, the wall portion 230 helps to prevent the infant from rolling over the wall portion 230 and/or off of the support member 210. The wall portion 230 is also configured to help prevent, or reduce the amount of, water entering the volume 220 (e.g., from over upper surface 232 of the wall portion 230) when the flotation device 200 is in use on water.

Figure 5:
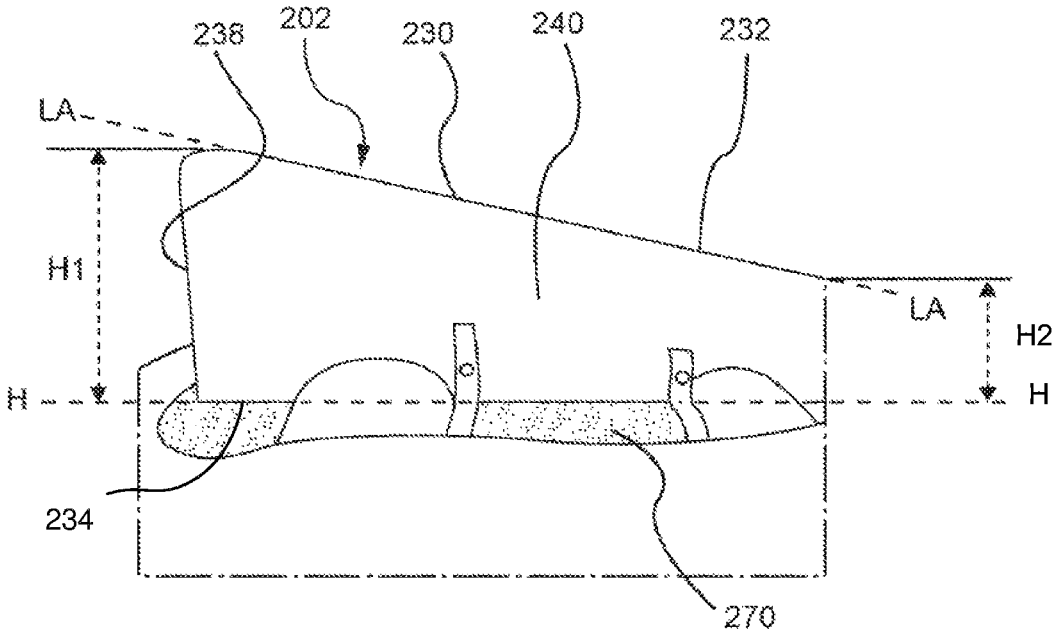
FIG. 5 is a side view of a portion of the apparatus of FIG. 3.

Referring to FIG. 5, when the flotation device 200 is inflated for use, a first portion of the wall portion 230 has a first height H1 and a second portion of the wall portion 230 has a second height H2 different than the first height H1. For example, the first portion of the wall portion 230 can include the portion of the wall portion adjacent the user's head when the device is in use and the second portion can include the portion of the wall portion 130 adjacent the user's legs and/or beneath the user's legs when the device is in use. As such, the first portion of the wall portion 230 adjacent the user's head can have a height H1 that is greater than the height H2 of the second portion of the wall portion 230 adjacent and/or beneath the user's legs. In some embodiments, the first and second portions of the wall portion 230 have the first and second heights, H1, H2, respectively, when the wall portion 230 is inflated to one of a maximum or predetermined volume. The height (e.g., first height H1, second height H2, or a height of a different portion of the wall portion 230) can be measured with respect to the distance between the upper surface 232 of the wall portion 230 and the lower surface 234 of the wall portion 230, or a horizontal plane H of the lower surface 234 of the wall portion 230 as shown in FIG. 5. The horizontal plane H of the lower surface 234 of the wall portion 230 can be parallel to or in the same plane as an upper surface of the water or other support surface. The first height H1 of the first portion of the wall portion 230 can be within the range of about 5 inches to about 10 inches, about 6 inches to about 9 inches, or about 7 inches to about 8 inches. The second height H2 of the second portion of the wall portion 230 can be within the range of about 1 inch to about 5 inches, about 2 inches to about 4 inches or about 3 inches to about 4 inches. For example, the first height H1 can be about 7.5 inches and the second height H2 can be about 3.4 inches.

In some embodiments, the height of the wall portion 230 decreases (e.g., at a predetermined angle, slope or incline), from the first portion of the wall portion 230 to the second portion of the wall portion 230. For example, the upper surface 232 of the wall portion 230 can be sloped or otherwise inclined from the first portion of the wall portion 230 downwardly to the second portion of the wall portion 230. In this manner, for example, the upper surface of the wall portion 230 can have a longitudinal axis that intersects with the horizontal plane H (see, e.g., FIG. 5).

The wall portion 230 is buoyant (e.g., on water or other suitable liquid). The wall portion 230 includes a membrane 240 and an inflatable bladder 246. The membrane 240 can be constructed of a flexible material. In some embodiments, the membrane 240 is impermeable to liquid. In other embodiments, the membrane 240 is at least semi-permeable to liquid (e.g., water). One or both of the membrane 240 and inflatable bladder 246 can be flexible. The membrane 240 of the wall portion defines at least a portion of a sleeve 242 within which the inflatable bladder 246 is disposed.

Figure 7:
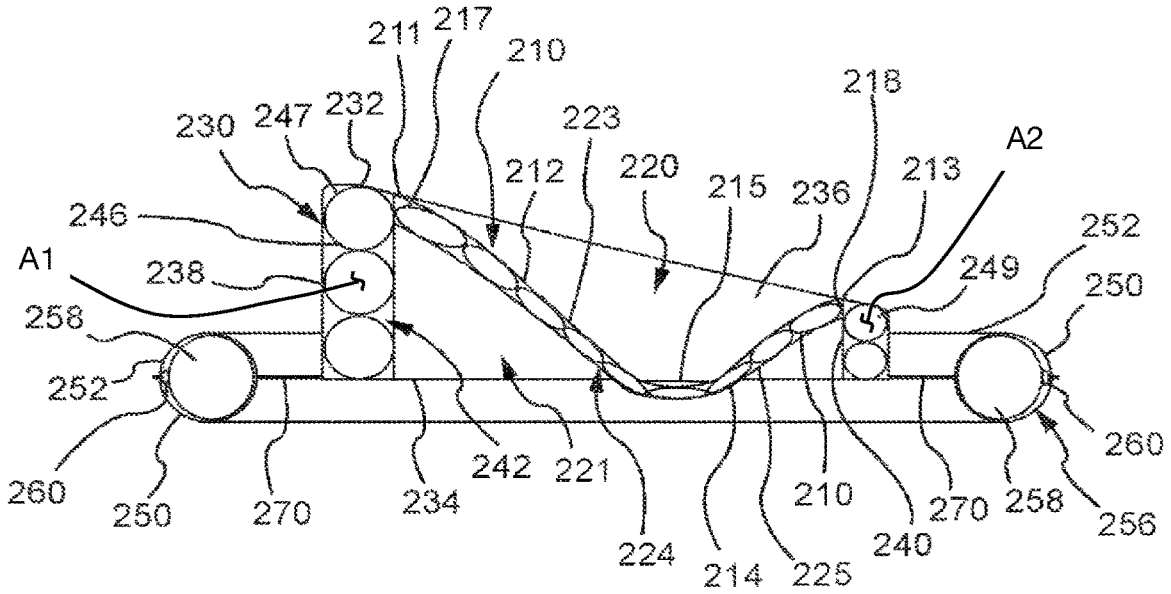
FIG. 7 is a cross-sectional view of the apparatus of FIG. 3, taken along line X-X, with portions of the apparatus removed for illustration purposes.

The inflatable bladder 246 of the wall portion 230 can include multiple inflatable chamber portions that are in fluid communication (e.g., gas or liquid from one inflatable chamber portion can flow to another inflatable chamber). When the inflatable bladder 246 is inflated, at least two of the inflatable chamber portions can be vertically stacked within the sleeve 242 of the wall portion 230. One or more inflatable chamber portions can be formed, for example, by one or more weld lines of the material forming the inflatable bladder, with the weld lines dividing the inflatable bladder 246 into the inflatable chamber portions. In some embodiments, the inflatable bladder forms at least one loop within the sleeve of the membrane of the wall portion 230. The inflatable bladder (or the inflatable chamber portions collectively) are looped within the sleeve about two and a half times, as shown in FIG. 7. The inflatable chamber portion can be stacked or otherwise positioned above another inflatable chamber portion for each loop, or portion thereof, above the first loop. As such, as shown in FIG. 7, the inflatable bladder 246 includes three inflatable chamber portions stacked within the first portion of the wall portion 230 and two inflatable chamber portions stacked within the second portion of the wall portion 230.

A first portion 247 of the inflatable bladder 246 of the wall portion 230 has a larger cross-sectional surface area (A1) than a cross-sectional surface area (A2) of a second portion 249 of the inflatable bladder 246 of the wall portion 230. The first portion 247 of the inflatable bladder 246 can be disposed within the first portion of the wall portion 230, and the second portion 249 of the inflatable bladder 246 can be disposed within the second portion of the wall portion 230.

The support member 210 of the cradle 202 is configured to support a user (e.g., the infant) reclined thereon. The support member 210 can be flexible, to conform to the user's body as described herein. The support member 210 can be buoyant. The support member 210 includes a membrane 222 and an inflatable bladder 216. One or both of the membrane 222 and the inflatable bladder 216 can be flexible. The membrane 222 includes a first layer 223 and a second layer 225 and defines a pocket 224 therebetween. The inflatable bladder 216 is at least partially disposed in the pocket 224 of the membrane 222 of the support member 210.

Figure 3:
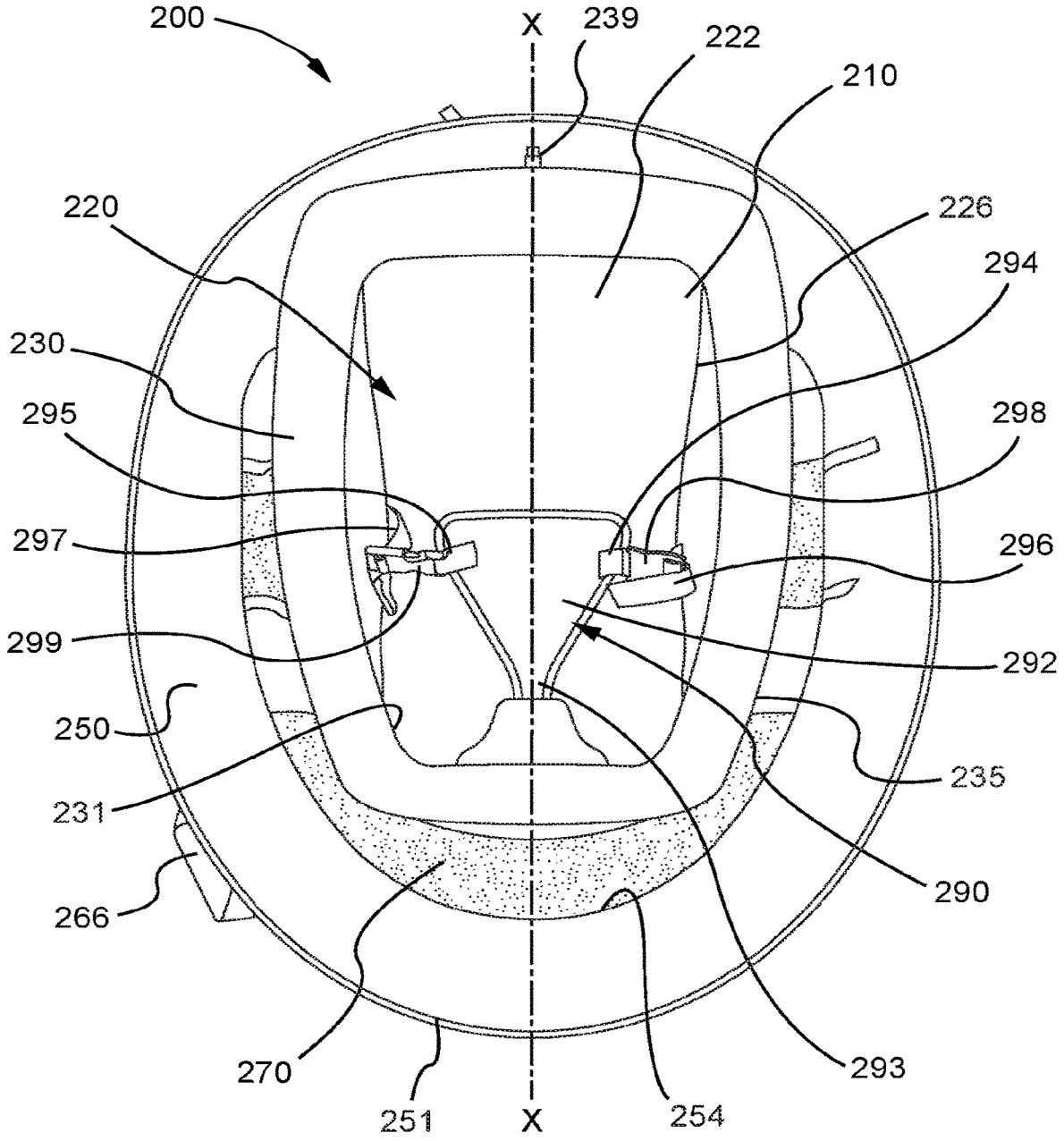
FIG. 3 is a top view of a flotation apparatus according to an embodiment.

The support member 210 can be disposed within an inner perimeter of the wall portion 230. The support member 210 is coupled to the wall portion 230. At least a portion of an outer perimeter portion (e.g., from a top view) of the support member 210 (e.g., an outer perimeter portion of one or both of the support member membrane's first and/or second layers 223, 225) is coupled to the wall portion 230 of the cradle 202. As best shown in FIG. 3, substantially an entirety of the outer perimeter of the support member 210 is coupled to the wall portion 230. More specifically, substantially an entirety of an outer perimeter of the membrane 222 of the support member 210 can be coupled to an interior perimeter of the membrane 240 of the wall portion 230.

The support member 210 (e.g., an outer perimeter of the support member) is coupled to the wall portion 230 (e.g., to the inner perimeter 231 of the wall portion) such that opposing first and second end portions (or first and second portions) 211, 213, respectively, of the support member 210 are coupled to the opposing first and second portions of the wall portion 230 at respective locations that are substantially at the first height H1 of the wall portion and the second height H2 of the wall portion 230, respectively. The support member 210 is also coupled to the wall portion 230 such that one or more side portions (e.g., a third portion) 215 of the support member 210 between the first and second end portions 211, 213 is coupled to the wall portion 230 at a third location that has a height less than the first height Hi and the second height H2. In some embodiments, the side portion 215 of the support member 210 is coupled, at least at one location, proximate the lower surface 234 of the wall portion 230. At least a portion of the support member 210 is configured to extend downwardly, in use, such that the portion (e.g., a middle portion with respect to a length and/or width of the support member 210) is lower than the lower surface 234 of the wall portion 230.

A first end portion 217 of the inflatable bladder 216 is coupled to the first portion of the wall portion 230 and a second end portion 218 of the inflatable bladder 216, different from and/or opposite the first end portion 217, is coupled to the second portion of the wall portion 230. In this manner, the first end portion 217 of the inflatable bladder of the support member 210 is separated by a first distance (e.g., substantially equivalent to the first height H1 of the wall portion 230), from a support surface (e.g., a surface of the water) or from the lower surface 234 of the wall portion, that is greater than a second distance (e.g., substantially equivalent to the second height H2 of the wall portion 230) by which the second end portion 218 of the inflatable bladder 216 is separated from the support surface or lower surface 234 of the wall portion 230.

The support member 210 has a longitudinal cross-sectional profile (e.g., taken along a longitudinal axis that extends at least between the first end portion 217 of the inflatable bladder and the second end portion 218 of the inflatable bladder, along the longer dimension of support member 210) that includes a concave portion. In some embodiments, the support member 110 has a longitudinal cross-sectional profile that includes a convex portion and a concave portion. For example, as best shown in FIG. 7, when the inflatable bladder 216 is inflated, a portion of the support member 210 proximate the third location of the wall portion 230 (or a middle portion of the longer dimension of the support member 210) can include a concave portion, and a portion of the support member 210 proximate the first end portion 217 (e.g., between the concave portion and the first end portion 217) can include a convex portion. In some embodiments, at least a portion of the support member 210 is concave along at least a portion of its width (e.g., between opposing side portions 215, along the shorter dimension of the support member 110). Such curvature of the support member 210 helps the support member to conform, at least in part, to the body of the user when reclined thereon.

The support member 210 is configured to receive and/or conform to different sized and/or shaped users (e.g., infants). In some embodiments, for example, the inflatable bladder 216 of the support member 210 is configured to produce a pillow effect such that air (or other liquid or gas) within the inflatable bladder is displaced therein in response to varying weight or pressure applied by various portions of the user's body disposed thereon. In this manner, the support member 210 is configured to conform, at least in part, to the body of the user.

A first portion of the support member 210 can have a first thickness (e.g., measured in a direction taken between its upper surface 212 and its lower surface 214, and a second portion of the support member 210 can have a second thickness less than the first thickness. A third portion of the support member 210 can have a third thickness greater than the second thickness and less than the first thickness. For example, in use, the first portion of the support member 210 can be proximate the user's head, the second portion of the support member 210 can be proximate the user's buttocks and the third portion of the support member 210 can be proximate the user's upper leg. The second portion of the support member 210, being thinner than the first and third portions of the support member 210 when the user is disposed thereon, helps to more easily retain or wedge in the user (e.g., an infant) therein. Said another way, the support member 210 can have a thinner or flatter portion (e.g., due to air being dispersed therein or due to construction of the support member 210 itself) at its bottom and disposed (lengthwise) between opposing thicker portions, in which the thinner portion has greater flexibility than the thicker portions. Because the thinner portion of the inflatable bladder 216 of the support member 210 has more flexibility than the thicker portions, the support member thereby encourages the user's body to tend towards, fold, sink, or otherwise roll into the thinner portion of the support member 210. The support member 210 having a thinner portion between opposing thicker portions can help to promote head-to-toe retention of a user in the volume 220 defined by the wall portion 230 and support member 210. In addition to or in lieu of promoting head-to-toe retention, the support member 210 having a thinner portion between opposing thicker portions can help to promote side-to-side retention of the user in the volume 220. The variation in thickness of the support member 210 can be due to a construction of the support member 210 (e.g., inflatable bladder 216 segments configured to have differing cross-sectional surface areas when inflated and in the absence of an external pressure thereon, or due to differing thickness of material of which one or more portions of the inflatable bladder 216 and/or the membrane 222 of the support member 210 are constructed) or due to the dispersing of air or other gas within the inflatable bladder 216 in response to an external pressure thereon, described above.

Figure 6:
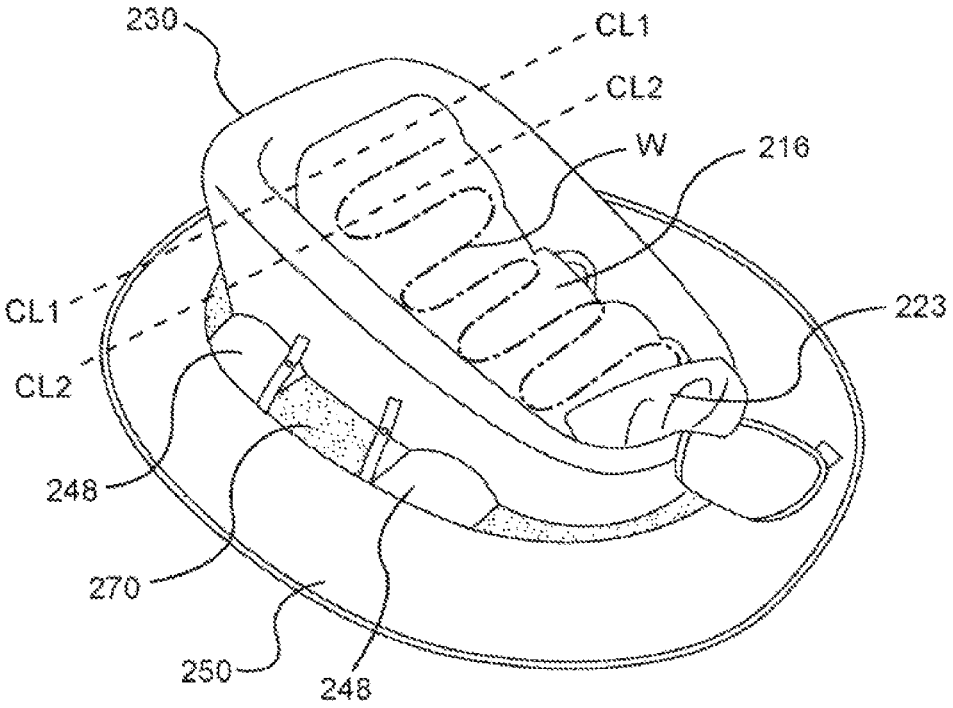
FIG. 6 is a perspective view of the apparatus of FIG. 3, with a portion of the apparatus removed for illustration purposes.

Referring to FIG. 7, in which the first layer 223 of the membrane 222 is partially removed for illustration purposes, the inflatable bladder 216 of the support member 210 includes a set of inflatable segments, two or more of which are in fluid communication. In this manner, the two or more inflatable segments can be inflated, for example by a single valve 219 (see FIG. 4). The inflatable bladder 216 can be welded in a manner to produce two or more inflatable segments that are fluidically coupled. For example, as shown in FIG. 6, the inflatable bladder 216 is welded with a substantially continuous sinusoidal weld (represented by broken line W for illustration purposes only) that separates the inflatable bladder into the inflatable segments (e.g., articulating segments). As such, a centerline of the inflatable bladder 216 has multiple bends. In this manner, the inflatable segments of the support member 210 can be arranged in substantially stacked or parallel rows. Said another way, two or more inflatable segments of the inflatable bladder 216 can have parallel centerlines CL1, CL2. Such a segmented inflatable bladder 216 allows the support member 210 to better conform to the user's shape (e.g., compared to an unsegmented inflatable bladder) and also helps to keep the center of gravity low for the user disposed thereon. One or more of the inflatable segments of the inflatable bladder 216 is configured to be compressed when the user is rested thereon, for example, to permit the dispersion of air as described above. Although the support member 210 is shown and described as including a single inflatable bladder 216 with multiple segments, in other embodiments, the support member 210 can include two or more inflatable bladders in lieu of any one or more (or all) of the inflatable segments.

Figure 4:
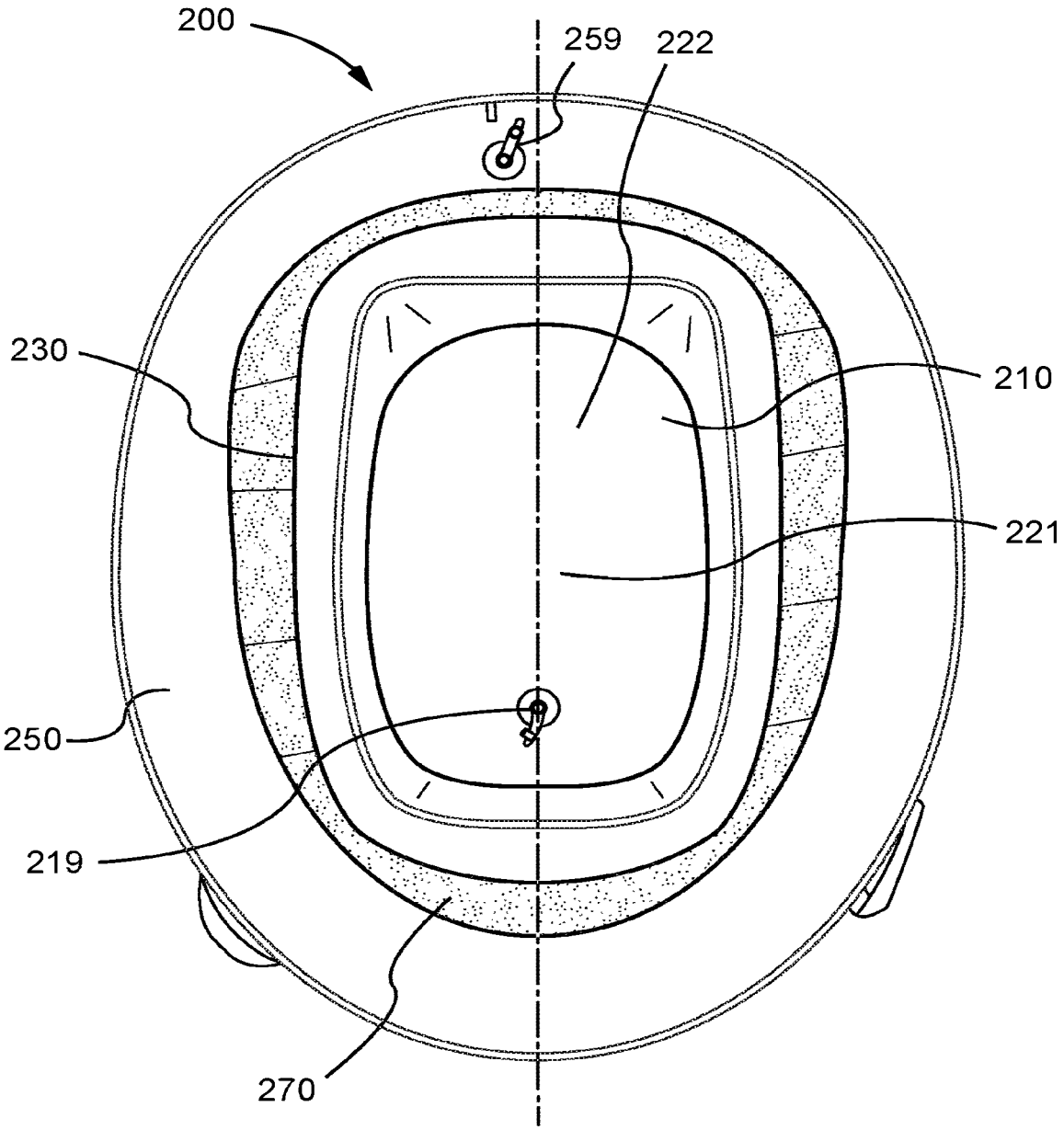
FIG. 4 is a bottom view of the apparatus of FIG. 3.
Figure 8:
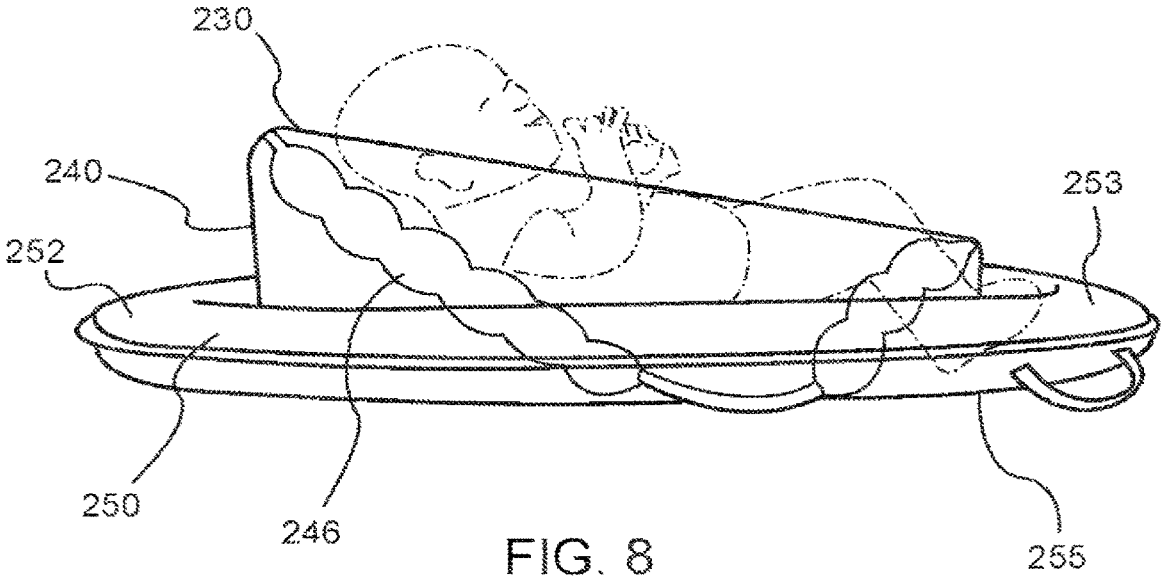
FIG. 8 is a side view of the apparatus of FIG. 3 shown with a representative user seated therein and portions of the apparatus shown transparent for illustration purposes.

Referring to FIGS. 4 and 7-8, a lower surface of the cradle 202 of the flotation device 200 defines a recess 221 having a volume. More specifically, the inner surface 236 of the wall portion 230 and the lower surface 214 of the support member 210 defined the recess 221. Portions of the support member 210 can move, bend, flex, or otherwise be displaced within the volume of the recess 221 to conform to the user's body during use, as described herein. Particularly, a middle portion of the support member 210 (e.g., a portion of the support member 210 proximate to or beneath the user's buttocks during use, or a portion of the support member 210 including the thinner or flattened inflatable segments) can conform to the user's body and/or be displaced by the user's body such that the middle portion is extended beneath the recess (e.g., and into the water) during use (e.g., as shown in FIGS. 7 and 8).

The flotation device 200 includes a safety harness 290 configured to be disposed over at least a portion of the user when the user is disposed within the volume 220 of the support member 210 and the wall portion 230. For example, as shown in FIG. 3, the safety harness 290 can be a three-point harness configured to retain the user at least partially within the cradle 202. The harness 290 includes a panel 292 coupled at a first end 293 to at least one of the support member 210 or the wall portion 230. At least a portion of the panel 292 is configured to be disposed between the legs of the user. First and second strap members 294, 295 are coupled to opposing sides of the panel 292, and each includes a first portion of a buckle 298, 299 or other suitable fastener. Third and fourth strap members 296, 297 are coupled at opposing sides of the support member 210, and each includes a second, complementary, portion of the respective buckle 298, 299 or other suitable fastener. In this manner, when the user is seated within the volume 220, the panel 292 can be brought up between the legs of the user, and the buckles 298, 299 each fastened, thereby coupling the first and third strap members 294, 296 together and the second and fourth strap members 295, 297 together, respectively, and at least partially securing the user within the volume 220 of the cradle 202. Although the harness 290 is shown as including a panel 292, in other embodiments, the harness could be differently configured, for example with one central strap and two side straps.

The flotation device 200 includes a stabilizing (or flotation, e.g., second flotation) member 250 disposed about at least a portion of an outer perimeter 235 of the wall portion (or first flotation member) 230 of the flotation device. The stabilizing member 250 is buoyant. The stabilizing member 250 is configured to help prevent the flotation device 200 from tipping over during use, for example, if the user (e.g., an infant) attempts to reach over the wall portion 230 of the flotation device 200 towards the water. For example, the stabilizing member 250 provides for a wider base of the flotation device, and therefore a lower center of gravity for the flotation device 200, for example, in comparison to that of the cradle 202 alone. The stabilizing member 250 is inflatable, however, in other embodiments, the stabilizing member is not inflatable (but can still be buoyant, e.g., made of foam). The stabilizing member 250 includes a membrane 252 and an inflatable bladder 258. The stabilizing member 250 can include a valve 259 for inflating and/or deflating the inflatable bladder 258. The membrane 252 defines a sleeve 256 (as best shown in FIG. 7), for example between a first layer 253 and a second layer 255 of the membrane (as shown in FIG. 8). The inflatable bladder 258 of the stabilizing member 250 can be disposed in the sleeve 256 of the membrane 252. As shown, the stabilizing member 250 can be substantially toroidal or oval in shape, and has an outer perimeter 251 and an inner perimeter 254 defining an opening within which at least a portion of the cradle 202 is disposed.

The stabilizing member 250 is spaced apart from and coupled to the cradle 202. More specifically, the outer surface 238 of the wall portion 230 of the cradle 202 is spaced apart from an inner perimeter of the stabilizing member 250. The flotation device 200 includes a membrane 270 (e.g., formed of flexible material such as a mesh, a liquid permeable material, or a material otherwise constructed to permit fluid to flow therethrough) disposed between an outer perimeter of the wall portion 230 and the inner perimeter of the stabilizing member 250. The membrane 270 can be configured to permit the user's feet to encounter water through the membrane during use. The flotation device 200 includes a set of struts 248, each of which extends from the wall portion 230 of the cradle 202 (e.g., the outer perimeter of the wall portion 230) to the stabilizing member 250 (e.g., the inner perimeter of the stabilizing member 250). The struts 248 are inflatable. More specifically, the strut can include an inflatable chamber (not shown), which can be disposed in a membrane. For example, the struts 248 can be in fluid communication with the inflatable bladder 246 of the wall portion 230 of the cradle 202, such that the struts 248 and the inflatable bladder 246 can be inflated by a single valve 239 (shown on the outer-facing surface 238 of the wall portion 230, in FIG. 3). In other embodiments, however, one or more struts can be fluidically coupled to the inflatable bladder 258 of the stabilizing member 250. One or more handles 266 can be coupled to the flotation member 200, for example, to an outer perimeter of the stabilizing member 250. The handles 266 can help a parent or other person hold onto the flotation device 200 during use.

The flotation device 200 includes a coilable spring 260. The coilable spring 260 is configured to fold upon itself to become more compact. The coilable spring 260 is configured to move the flotation device 200 between a first configuration in which the coilable spring 260 is collapsed and the flotation device 200 is folded in upon itself and a second configuration in which the coilable spring 260 is extended and the flotation device 200 is unfolded (and inflated or ready for inflation).

The coilable spring 260 can be coupled to an outer perimeter of the flotation device 200. The coilable spring 260 can be coupled to an outer perimeter portion of the stabilizing member 250. More specifically, the spring 260 can be disposed within the sleeve 256 of, the stabilizing member 250. Although the stabilizing member 250 is shown and described herein as including sleeve 256, in other embodiments, the stabilizing member 250 can include two sleeves or sleeve portions, and the inflatable bladder 258 can be disposed in one sleeve (or sleeve portion) and the coilable spring 260 disposed in the other sleeve (or sleeve portion) of the stabilizing member 250. The stabilizing member 250 can include one or more loops configured to receive the coilable spring therethrough to couple the coilable spring to the stabilizing member 250, and to the flotation device 200 as a whole.

The coilable spring 260 can be manufactured from a waterproof material or coated with a waterproof material. The spring 260 can be constructed of any suitable material, including but not limited to, metal (e.g., steel), plastic or other material. The coilable spring 260 can be a single continuous element or can include multiple spring elements, which can optionally be coupled together by a joint, such as a sleeve joint, that joins the ends of one or more spring elements. The coilable spring 260 can be of any appropriate shape and dimension. The coilable spring 260 can have shape memory such that is biased to return to its uncoiled configuration when not held in the coiled configuration (e.g., by a restraint, container, or the like). The coilable spring can be similar in many respects or identical to the coilable spring disclosed in the '949 patent, incorporated herein by reference.

Figure 9:
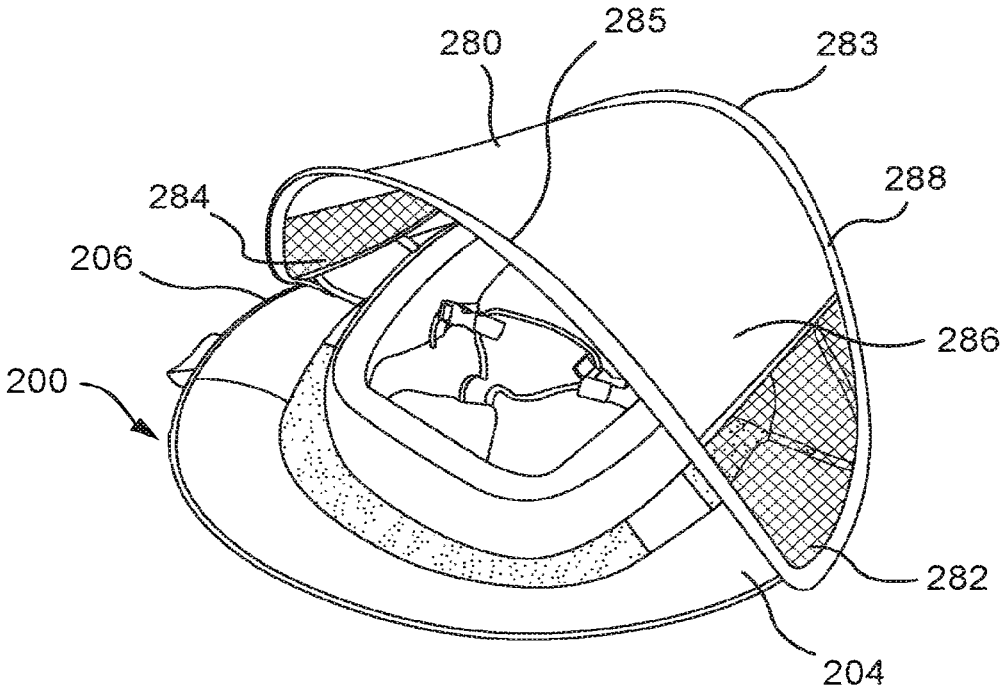
FIG. 9 is a perspective view of the apparatus of FIG. 3 including a canopy in a first position.
Figure 10:
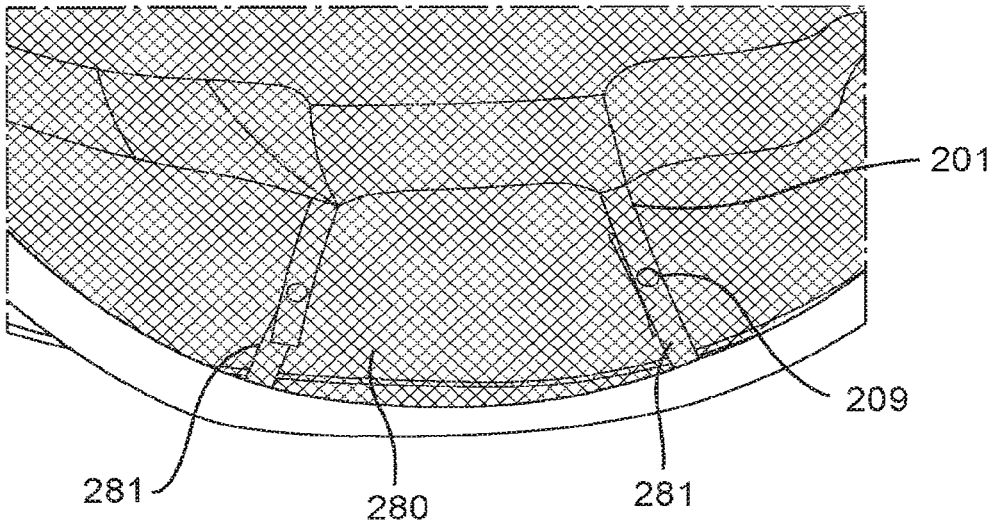
FIG. 10 is a side view of a portion of the canopy of FIG. 9.
Figure 11:
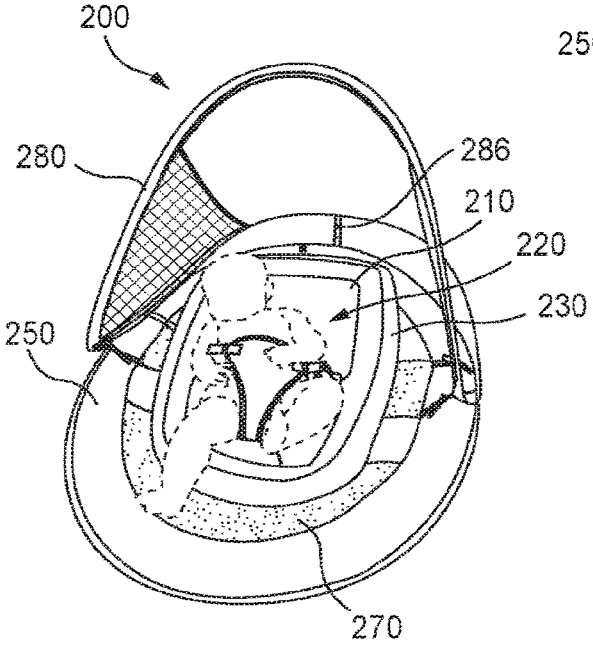
FIG. 11 is a front perspective view of the apparatus of FIG. 3 including the canopy in a second position, and in which the apparatus is on water with a user seated thereon.
Figure 12:
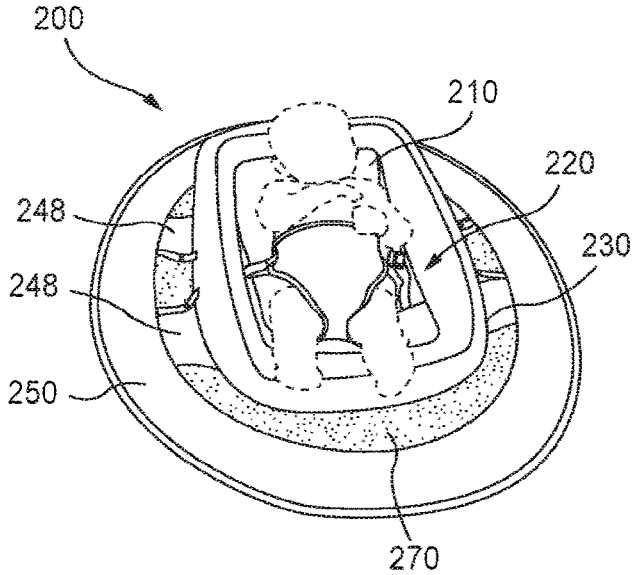
FIGS. 12-13 are front and side perspective views, respectively, of the apparatus of FIG. 3 and in use with a user seated thereon and the apparatus on water.
Figure 13:
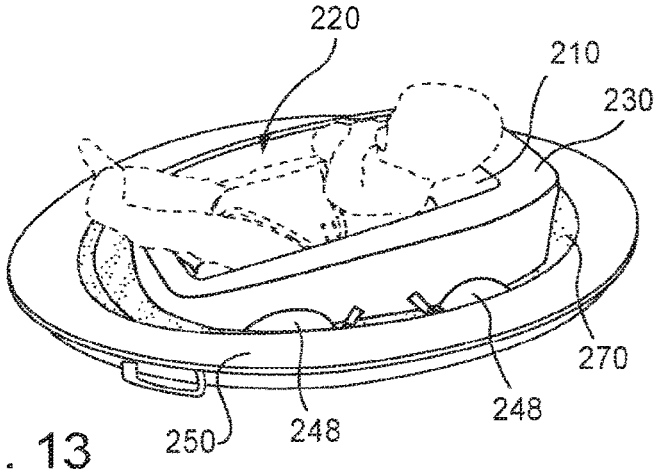

The flotation device 200 can include a canopy 280. The canopy 280 can be reversibly coupled to the flotation device 200. For example, as shown in FIGS. 9 and 11, the canopy 280 can be coupled at a first end 282 to a first side portion 204 of the flotation device 200 and at a second end 284 to a second side portion 206 of the flotation device 200 opposite the first side portion. For example, the canopy 280 can be coupled to the stabilizing member 250 and/or the liquid permeable membrane 270 via one, two, three, four or more of at least one of snaps, straps, buttons, buckles, ties, hook-and-loop fasteners (e.g., Velcro®), or the like, or any suitable combination of the foregoing. As shown, the canopy 280 includes four straps 281 with a snap connector portion (not shown in FIGS. 9-10) configured to be coupled to a complementary snap connector portion 209 that is disposed on a strap 201 coupled to the flotation device 200 proximate the inner perimeter of the stabilizing member 250, as shown in FIGS. 9-10.

The canopy includes a membrane 286 and a perimeter portion 288. The canopy 280 is configured to shield at least a portion of the user's body, when seated within the volume 220 of the flotation device, from ultraviolet rays of the sun. At least a portion of the canopy 280, such as the membrane 286, can include a sun protective Ultraviolet Protection Factor ("UPF") rated fabric or coating (e.g., with a UPF rating of UPF 50, UPF 40, or the like). At least a portion of the canopy 280, such as the membrane 286, is constructed of a flexible material similar to that used for one or more membranes of the flotation device 200. For example, the canopy 280 can include a central panel of a first flexible material, which can be similar to the membrane material of one or more of the support member 210, the wall portion 230 or the stabilizing member 250 of the flotation device, and two panels flanking the central panel, which can be constructed at least in part by the liquid permeable (e.g., mesh) material described herein. The perimeter portion 288 of the canopy 280 can include a coilable spring (not shown) configured to fold upon itself to become more compact. The coilable spring is configured to move the canopy 280 between a first configuration in which the coilable spring is collapsed and the canopy 280 is folded in upon itself and a second configuration in which the coilable spring is extended and the canopy 280 is unfolded (and, optionally, ready to be coupled to the flotation device 200).

The canopy 280 can be movable with respect to the flotation device 200. For example, the canopy 280 can have a first (or overhead) position in which the canopy is positioned over the cradle 202 and in which each of a first (or rear) edge 283 of the canopy 280 and a second (or forward) edge 285 of the canopy 280 is spaced apart (e.g., 5 inches or more) from an upper surface of the flotation device 200 (or more specifically, from a portion of the stabilizing member 250 behind the cradle 202). The canopy 280 can be biased towards the first position, for example, when the canopy 280 is coupled at is first and second end portions 282, 284 to the first and second side portions 204, 206, respectively, of the flotation member 200. The canopy 280 can have a second (or behind-the-cradle) position in which a first (or rear) edge 283 of the canopy 280 is in contact with or spaced less than 5 inches apart from the upper surface of the flotation device 200. The canopy 280 can be coupleable to the flotation device 200 to retain the canopy 280 in its second position. For example, the canopy 280 includes a coupling strap 281 with complementary portions of a snap connector disposed on the coupling strap. The coupling strap 281 extends from the first (or rear) edge 283 of the canopy 280. The coupling strap 281 is configured to be partially disposed through a loop coupled to an outer perimeter of the stabilizing member 250 and then folded back upon itself such that the complementary portions of the snap connector are coupled together, thereby retaining the canopy 280 in its second position. In some embodiments, the canopy 280 can have a third (or forward) position in which the second edge 285 of the canopy is in contact with or spaced less than 5 inches apart from an upper surface of the flotation device 200 (or more specifically, from a portion of the stabilizing member 250 forward of the cradle 202). In such embodiments, the canopy 280 can include a coupling strap (not shown) coupled to the second (or forward) edge 285, which can be operable similar to the coupling strap 281 to retain the canopy 280 in the third position. Although the canopy 280 is shown and described as being removably couplable to the flotation device 200, in other embodiments, the canopy can be fixedly coupled to the flotation device.

Any suitable fabric can be used to construct the various portions of the flotation device, including but not limited to polyester, Textiline, polyvinyl chloride, polypropylene, polyoxymethylene, nylon, a metal alloy, or the like, or combination thereof. One such suitable material includes: Polyester—40.00% (210D Man Body)/(190T with UV protection Canopy); Textilene (Poly-Pongee)—15.00%; PVC Polyvinyl Chloride—20.00%; 10 Gauge PP Polypropylene—8.00%; POM Polyoxymethylene—2.00%; and Metal Alloy—15.00%.

Although the flotation device shown and described herein is substantially oval or toroidal in shape (from a top or bottom view), the flotation device can be differently shaped in other embodiments. For example, a flotation device according to an embodiment can have a substantially circular, square, rectangular or diamond shaped outer perimeter (from a top and/or bottom view).

Although the flotation device is shown and described herein as including an upper surface 232 of the wall portion that is substantially linear, in other embodiments, the upper surface of the wall portion (or wall of the cradle) can be differently shaped. For example, in some embodiments, an upper surface of one or more segments of the wall of the cradle is non-linear. More specifically, for example, an upper surface of side portions of the wall of the cradle can be curved (e.g., concavely with respect to the upper surface, convexly with respect to the upper surface, or a combination thereof).

Although the flotation device is shown and described herein as including three valves, each of which is associated with one of the inflatable bladders of the flotation device, in other embodiments, a flotation device can include any suitable number of valves. For example, in one embodiment, all inflatable bladders of the flotation device could be fluidically coupled, and thus the flotation device can include one valve. In other embodiments, the flotation device can include two, four or more valves.

Although portions of the flotation devices are shown and described herein as including a single inflatable bladder (e.g., the inflatable bladder of the wall 130, the inflatable bladder of the support member, the inflatable bladder of the stabilizing member), in other embodiments, each portion of the flotation device can include any suitable number, e.g., two, three, four, or more, of inflatable bladders. For example, in some embodiments, the stabilizing member includes two inflatable bladders, which can be disposed on opposing sides of the flotation device. In another example, in some embodiments, the stabilizing member can include four inflatable bladders. In another example, the wall 130 can include two, three or four inflatable bladders.

Although the wall portion (e.g., wall portion 130, wall portion 230) is described as being inflatable, in other embodiments, the wall portion 230 is not inflatable. For example, the wall portion 230 can be constructed of a buoyant material, such as, but not limited to, foam, plastic, or the like.

Although the flotation device has been shown and described herein as including multiple inflatable bladders, any one or more of the inflatable bladders could instead be or include a different type of buoyant member, such as a non-inflatable buoyant member (e.g., foam or the like).

Although the first portion 247 of the inflatable bladder 246 of the wall portion 230 has been shown and described as having a larger cross-sectional surface area than a cross-sectional surface area of the second portion 249 of the inflatable bladder 246 of the wall portion 230, in other embodiments, various portions or segments of the inflatable bladder of the wall portion can be differently sized and/or shaped. For example, in some embodiments, the first portion of the inflatable bladder and the second portion of the inflatable bladder can have substantially similarly sized and/or shaped cross-sectional surface areas.

Although the flotation device has been shown and described herein as including a cradle (e.g., cradle 202) with a wall portion (e.g., wall portion 230) that is separate and fluidically isolated from a support member (e.g., support member 210), in other embodiments, a flotation device can include a cradle with a wall portion fluidically coupled to a support member. In this manner, the wall portion and the support member of the cradle can be inflated via a single inflation valve. In another example, in other embodiments, a flotation device can include a cradle that does not have a wall portion distinct from the support member. For example, the support member can be constructed with side portions that are sized and shaped (e.g., having a raised edge height) to help retain the infant thereon and/or to help prevent or reduce the amount of water entering a seat portion of the support member. In still another example, in other embodiments, a flotation device can include a cradle in which the wall portion and support member are monolithically constructed (e.g., from foam or other buoyant material).

Although the flotation device has been shown and described herein as including a coilable spring (e.g., coilable spring 260), in other embodiments, the flotation device does not include a coilable spring. In other words, the coilable spring can be optional. In some embodiments, for example, a flotation device includes a different closure mechanism configured to collapse the flotation device, e.g., for carrying or storage.

Although the flotation device 200 has been shown and described as including a liquid (or fluid) permeable membrane 270 between the wall portion 230 of the flotation device 200 and the stabilizing member 250 of the flotation device 200, in other embodiments, the membrane can be impermeable or semi-impermeable to liquid.

Although the flotation device 200 has been shown and described as including the stabilizing member 250 coupled to the cradle 202 by the liquid permeable member 270 and/or struts 248, in other embodiments, the stabilizing member can be coupled to the cradle 202 in a different manner. For example, the stabilizing member can be coupled to the cradle by a tether, a rigid member, or any other suitable connector. Furthermore, although the struts 248 are shown and described herein as including a pair of struts 248 on each side of the flotation device 200, with the struts 248 of each pair being substantially parallel, in other embodiments, the struts 248 can be differently arranged. For example, in some embodiments, the struts can be arranged non-parallel (e.g., in a ray-like or starburst-like arrangement).

Although the flotation device 200 has been shown and described as including struts 248 extended between the cradle 202 and the stabilizing member 250, in other embodiments, such struts are optional. For example, in some embodiments, the flotation device includes a membrane between the cradle and the stabilizing member without one or more, or any, struts. Although the struts 248 are shown and described herein as being inflatable, in other embodiments, the struts 248 are not inflatable (e.g., buoyant but not inflatable, or non-buoyant and not inflatable).

Furthermore, although the stabilizing member 250 has been shown and described as being spaced apart from the cradle 202 of the flotation device 200, e.g., by struts 248 and/or by the liquid permeable membrane 270, in other embodiments, the stabilizing member is directly coupled to (i.e., in contact with) at least a portion of the cradle 202 (e.g., to the wall portion 230).

Figure 14:
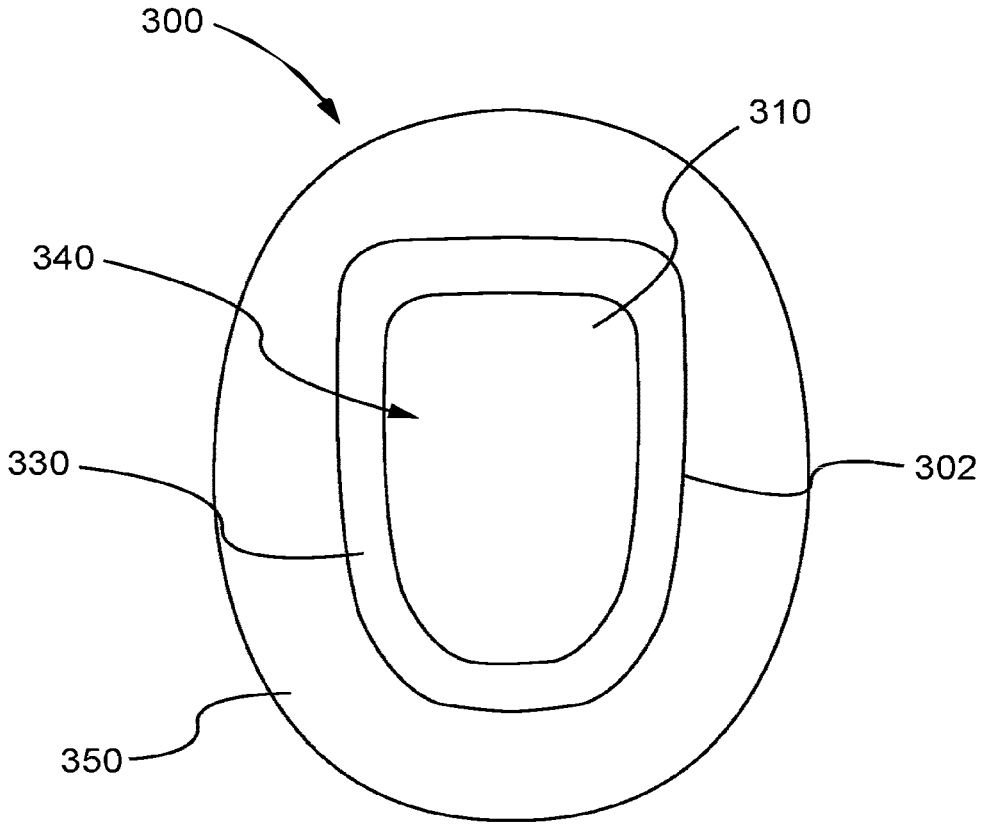
FIG. 14 is a top view of an apparatus according to an embodiment.
Figure 15:
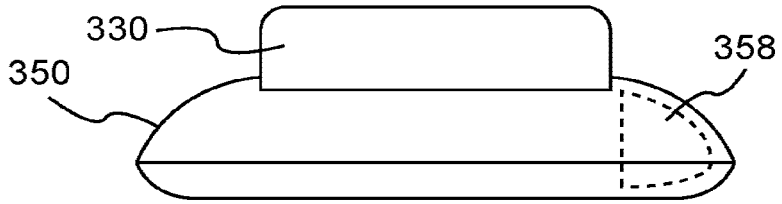
FIG. 15 is a front view of the apparatus of FIG. 14.

For example, in some embodiments as shown in FIGS. 14-15, an apparatus is a flotation device 300 having a support member 310, a wall 330 and a stabilizing member 350 disposed about and coupled to at least a portion of a perimeter of the wall. One or more elements of the flotation device 300 can be similar in many respects, or identical to elements of the flotation devices 100, 200 described herein, and so are not described in detail herein. The wall 330 and stabilizing member 350 collectively form a cradle 302 with a seating portion 340. The stabilizing member 350 is inflatable (e.g., has an inflatable bladder therein or is constructed of an inflatable material). In the embodiment shown in FIG. 15, the stabilizing member 350 is coupled directly to the wall 330 of the flotation device 300.

In the embodiment shown in FIGS. 3-13, the inflatable bladder 258 of the stabilizing member 250 has a generally round or circular cross-sectional profile when inflated (see, e.g., FIG. 7). In other embodiments, however, the inflatable bladder of the stabilizing member can have a different cross-sectional profile when inflated. For example, referring again to the flotation device 300 shown in FIGS. 14-15, the cross-sectional profile 358 of the inflatable bladder of the stabilizing member 350 can be a rounded triangular shape as schematically shown in dashed lines in FIG. 15 for illustrative purposes only. The upper surface of the stabilizing member 350 slopes downwardly from an inner perimeter of the stabilizing member towards an outer perimeter of the stabilizing member, which helps to direct water thereon away from the wall 330 of the flotation device 300 and off of the stabilizing member 350.

In still other embodiments, the stabilizing member (e.g., stabilizing member 250, 350) is optional. For example, a flotation device can include a buoyant cradle 202, 302 that is sized and shaped to prevent tipping over of the flotation device during use. For example, in some embodiments, a flotation device includes a cradle that has an overall width and/or overall length that provides stability to the cradle such that the flotation device prevents tipping and/or overturning of the device during normal use. In another example, a flotation device can include a cradle with a support member that has a center portion that is disposed lower, with respect to a lower surface of a wall portion of the cradle, than a center portion of the support member 210 with respect to wall portion 230, thereby lowering the center of gravity of the flotation device. In still another example, a flotation device includes a cradle that has a wall portion with a trapezoidal shaped cross-sectional profile. In this manner, the wall portion of the cradle can have a greater width at its base than at its top, thereby providing additional stability to the flotation device.

Although portions of the flotation device have been shown and described herein as including a membrane and an inflatable bladder disposed within a sleeve or pocket of the membrane, in other embodiments, such portions can be inflatable without a separate inflatable bladder. For example, in some embodiments, the support portion includes a membrane defining one or more inflatable chambers without a surrounding sleeve or pocket. In another example, one or both of the wall or the stabilizing portion can include a membrane that defines one or more inflatable chambers. In such embodiments, the membrane can be manufactured from a gas impermeable material.

Similarly, in some embodiments, the flotation device can include one or more inflatable bladders described herein without a surrounding membrane. More specifically, the sleeves and/or pockets formed by the membrane as described herein are optional, and flotation devices according to other embodiments may not include one or more of such sleeves, pockets, or a membrane separable from the inflatable bladder.

Although the flotation device 200 has been shown and described as including a cradle 202 that defines a recess 221 with respect to a lower surface of the cradle defined by lower surface 214 of the support member 210 and the inner surface 236 of the wall portion 230, in other embodiments, a lower surface of the cradle can be differently configured. For example, in some embodiments, a lower surface of the cradle (e.g., collectively formed by the lower surface 234 of the wall portion 230 and the lower surface 214 of the support member 210) can be substantially planar, outwardly curved, or another suitable shape.

While various embodiments have been described above, it should be understood that they have been presented by way of example only, and not limitation. Where schematics and/or embodiments described above indicate certain components arranged in certain orientations or positions, the arrangement of components may be modified. While the embodiments have been particularly shown and described, it will be understood that various changes in form and details may be made. Although various embodiments have been described as having particular features and/or combinations of components, other embodiments are possible having any combination or sub-combination of any features and/or components from any of the embodiments described herein.

The specific configurations of the various components described herein can also be varied. For example, the size and specific shape of the various components can be different from the embodiments shown, while still providing the functions as described herein. Additionally, the relative size of various components of the devices shown and described herein with respect to the size of other components of the devices are not necessarily to scale. Similarly, where methods and/or events described above indicate certain events and/or procedures occurring in certain order, the ordering of certain events and/or procedures may be modified. While the embodiments have been particularly shown and described, it will be understood that various changes in form and details may be made.

The invention claimed is:

1. An infant float, comprising:

a first flotation member that has an inflatable bladder and having an inner perimeter and an outer perimeter, the first flotation member having a first height when inflated;

a support member that is inflatable and at least partially disposed within the inner perimeter of the first flotation member, the support member having an upper surface, at least a portion of which is recessed with respect to an upper surface of the first flotation member; and a second flotation member that is inflatable and having an inner perimeter disposed about at least a portion of the outer perimeter of the first flotation member, the second flotation member having a first height, when inflated, that is less than the maximum first height of the first flotation member, at least a portion of the inner perimeter of the second flotation member being spaced apart from the outer perimeter of the first flotation member.

2. The infant float of claim 1, wherein:

a first end portion of the first flotation member has the first height when the first flotation member is inflated, a second end portion of the first flotation member has a height that is less than the first height when the first flotation member is inflated.

3. The infant float of claim 1, wherein the upper surface is sloped from a first end portion of the first flotation member to a second end portion of the first flotation member.

4. The infant float of claim 1, wherein the first flotation member and the support member are collectively configured to support a user on water and in a reclined position such that the user's head is supported above the water by the first end portion of the support member and such that at least one of the second end portion of the support member and a portion of the first flotation member is disposed beneath a leg of the user.

5. The infant float of claim 1, further comprising:

a liquid permeable membrane disposed between at least a portion of the first flotation member and the second flotation member.

6. The infant float of claim 1, wherein a cross-sectional area of the inflatable bladder at a first end portion of the first flotation member is larger than a cross-sectional area of the inflatable bladder at a second end portion of the first flotation member.

* * * * *